US005902943A

United States Patent [19]

Schaffer et al.

[11] Patent Number: 5,902,943

[45] Date of Patent: May 11, 1999

[54] ALUMINIUM ALLOY POWDER BLENDS AND SINTERED ALUMINIUM ALLOYS

[75] Inventors: Graham Barry Schaffer, Fig Tree Pocket; Roger Neil Lumley, West End; Shuhai Huo, Toowong, all of Australia

[73] Assignee: The University of Queensland, Queensland, Australia

[21] Appl. No.: 08/945,904

[22] PCT Filed: May 2, 1996

[86] PCT No.: PCT/AU96/00256

§ 371 Date: Oct. 31, 1997

§ 102(e) Date: Oct. 31, 1997

[87] PCT Pub. No.: WO96/34991

PCT Pub. Date: Nov. 7, 1996

[30] Foreign Application Priority Data

May 2, 1995 [AU] Australia ..... PN 2736

[51] Int. Cl.[6] ..... C22C 21/10

[52] U.S. Cl. ..... 75/249; 75/231; 75/232; 75/236; 75/243; 75/252; 75/254

[58] Field of Search ..... 75/231, 249, 252, 75/254, 232, 236, 543; 419/38

[56] References Cited

U.S. PATENT DOCUMENTS

| | | | |
|---|---|---|---|
| 3,637,441 | 1/1972 | Lyle, Jr. et al. | 148/32.5 |
| 4,661,154 | 4/1987 | Faure | 75/231 |
| 4,664,704 | 5/1987 | Dohonomoto et al. | 75/229 |
| 4,770,848 | 9/1988 | Ghosh et al. | 419/28 |
| 4,857,267 | 8/1989 | Maki et al. | 419/31 |

FOREIGN PATENT DOCUMENTS

| | | |
|---|---|---|
| 133248 | 11/1946 | Australia . |
| 0 353 773 A1 | 2/1990 | European Pat. Off. . |
| 0 436 952 A1 | 7/1991 | European Pat. Off. . |
| 76-48557X/26 | 5/1976 | Japan . |
| 84-091732/15 | 3/1984 | Japan . |
| 87-330691/47 | 10/1987 | Japan . |
| 88-144481/21 | 4/1988 | Japan . |
| 07090551 | 4/1995 | Japan . |
| 2 107 738 | 5/1983 | United Kingdom . |

*Primary Examiner*—Ngoclan Mai
*Attorney, Agent, or Firm*—Cantor Colburn LLP

[57] ABSTRACT

The invention relates to an aluminum powder blend and sintered components produced from the aluminum powder blend. The powder is based on the precipitation hardenable 7000 series Al-Zn-Mg-Cu alloys with trace addition of lead or tin. The powder blend comprises 2–12 wt. % zinc, 1–5 wt. % magnesium, 0.1–5.6 wt. % copper, 0.01–0.3 wt. % lead or tin, and the balance aluminum. The invention also provides a composite powder comprising the foregoing powder blend and a reinforcing element or compound.

21 Claims, 2 Drawing Sheets

*(a)* *(b)*

ALUMINIUM ALLOY POWDER BLENDS AND SINTERED ALUMINIUM ALLOYS

TECHNICAL FIELD

This invention relates to an aluminium alloy powder blend for the production of a sintered aluminium alloy. The invention also relates to sintered aluminium alloys formed from the starting powder and articles prepared from the sintered aluminium alloys.

BACKGROUND ART

Powder Metallurgy (P/M) is the technology of transforming metal powders into semi-finished or finished products by mechanical and thermal operations. Advantages of using P/M techniques include the ability to fabricate specialty alloys with unique compositions, microstructures and properties; to make parts of complex shape to close tolerances without secondary processing; and to produce alloys, such as the refractory and reactive metals, which can only be fabricated in the solid state as powders. Standard P/M techniques involve the pressing of metal powders in a die, the removal of the green part from the die, and the sintering of the part in a furnace under a controlled atmosphere. The starting powder may be a blend of pure elemental powders, a blend of master alloy powders, fully alloyed powders or any combination thereof. Non-metallic particulate materials may be added to make composites. The sintering process causes metallic bonds to form between the powder particles. This provides most of the strength. Bonding and/or densification may be aided by the development of liquid phases during sintering. These may or may not persist to the completion of sintering. These liquid phases may form by melting of elements or compounds, by the incipient melting of pre-existing eutectic compounds, or by the melting of eutectics which form by diffusional processes during sintering. The alloy may be used in the as sintered state or may be further processed. Secondary processes include coining, sizing, re-pressing, machining, extrusion and forging. They may also be surface treated and/or impregnated with lubricating liquids. Many metals are fabricated this way, including iron and steel, copper and its alloys, nickel, tungsten, titanium and aluminium.

The difficulty in sintering metal powders is a consequence of the surface oxide film which is present on all metals. This oxide film is a barrier to sintering because it inhibits inter particle welding and the formation of effective inter particle bonds. The problem is particularly severe in aluminium because of the inherent thermodynamic stability of the oxide ($Al_2O_3$). Current P/M processed aluminium alloys are used principally in business machines where high mechanical strength is not required but where low inertia and corrosion resistance are important properties. There is, however, a demand for high strength, pressed and sintered aluminium alloys.

A general maxim in materials engineering is that alloys are tailored to the manufacturing process as much as to the application because different processes require different properties. Thus cast steels are different to both rolled steels and P/M steels; directionally solidified single crystal nickel superalloy turbine blades have a different composition to conventionally cast blades and aluminium extrusion alloys are different to forging alloys which in turn are different to casting alloys and rapidly solidified alloys. However, this principle has not yet been applied to pressed and sintered aluminium alloys. Current commercial alloys are predominantly based on the wrought alloys 6061 and 2014, which are Al-Mg-Si and Al-Cu-Si-Mg alloys, respectively. They have not been optimised for the P/M process.

U.S. Pat. No. 5,304,343 describes a method of producing a sintered aluminium alloy having improved mechanical properties. However, the alloy according to this patent is made using an expensive master alloy route and is based on 2,000 and 6,000 series alloys.

There is thus a need for an aluminium alloy powder blend, and sintered aluminium alloys produced therefrom, which provide higher tensile strength alloys for use in a broader range of applications than has hitherto been possible.

SUMMARY OF THE INVENTION

It is an object of the present invention to provide an aluminium alloy starting powder for manufacturing a sintered aluminium alloy having improved mechanical properties over previously known sintered-aluminium alloys.

According to a first embodiment of the invention, there is provided an aluminium alloy starting powder blended from pure elemental powders for a sintered aluminium alloy, said powder blend consisting essentially of 2–12 wt % zinc, 1–5 wt % magnesium, 0.1–5.6% copper, 0.01–0.3 wt % lead or tin, and the balance aluminium.

Preferred concentrations for the components of the powder are: zinc, 4–8 wt %; magnesium, 1.5–3.5 wt %; copper 1–4 wt %; and, lead or tin, 0.03–0.15 wt %.

Of the trace elements lead or tin, lead is preferred.

Typically, starting powder according to the first embodiment includes a solid lubricant such as stearic acid or waxes based on stearic acid, or other organic lubricant. A preferred solid lubricant is stearic acid in an amount between 0.1 and 2 wt %. Preferably, the stearic acid is in an amount of 0.5–1 wt %.

The size of zinc particles in the powder are advantageously of larger size than is conventionally used. Zinc particles of 60 mesh to dust in conjunction with aluminium particles of 50 mesh to dust are preferred (particle sizes by screening—ASTM E-11 mesh numbers). Other parameters such as heating rate and compaction pressure can be varied to enhance the zinc size effect as will be discussed below. This aspect of the invention is applicable to any zinc-containing aluminium alloy powder blend.

According to a second embodiment of the invention, there is provided a composite starting powder for a sintered aluminium alloy, said powder consisting essentially of a powder according to the first embodiment together with at least one reinforcing element or compound.

The reinforcing element or compound of the second embodiment is typically, but is not limited to, carbon, carborundum, corundum, titanium diboride, fly ash, cermets, silicon carbide or other oxides, carbides, nitrides and borides. In the composite powder of the second embodiment, the reinforcement typically comprises 2 vol % to 50 vol % of the composite with the balance being the alloy powder of the first embodiment. A preferred proportion of the reinforcement is 5 vol % to 30 vol %.

In a third embodiment of the invention, there is provided a sintered aluminium alloy, which alloy is produced by the steps of:

(i) compacting a powder according to the first embodiment or a composite according to the second embodiment at a pressure of up to 600 MPa; and (ii) sintering said compacted material from step (i) at a temperature of 550° C. to 640° C.

In producing the sintered aluminium alloy of the third embodiment, a compaction pressure of 200 MPa to 500 MPa is preferred. Heating of the compacted material to the sintering temperature is typically at a rate greater than 5° C./min and is preferably at a rate of between 10° C./min and 40° C./min.

The compacted material is typically held at the sintering temperature for not more than 2 h. Preferred sintering times and temperatures are 10–30 min and 600–630° C.

The invention includes within its scope articles manufactured from the sintered aluminium alloy of the third embodiment. Articles can also be manufactured from the sintered alloy by processes such as, but not restricted to, powder forging or extrusion.

BEST MODE AND OTHER MODES FOR PERFORMING THE INVENTION

As indicated above, this invention relates to the development of an aluminium alloy powder blend which can be used for the manufacture of sintered components. The sintered component can be subjected to secondary processing operations. Specifically, this invention is concerned with the composition of the alloy and the powder size distribution, particularly that of the alloying additions, which optimises the sintering process.

Figure 1:
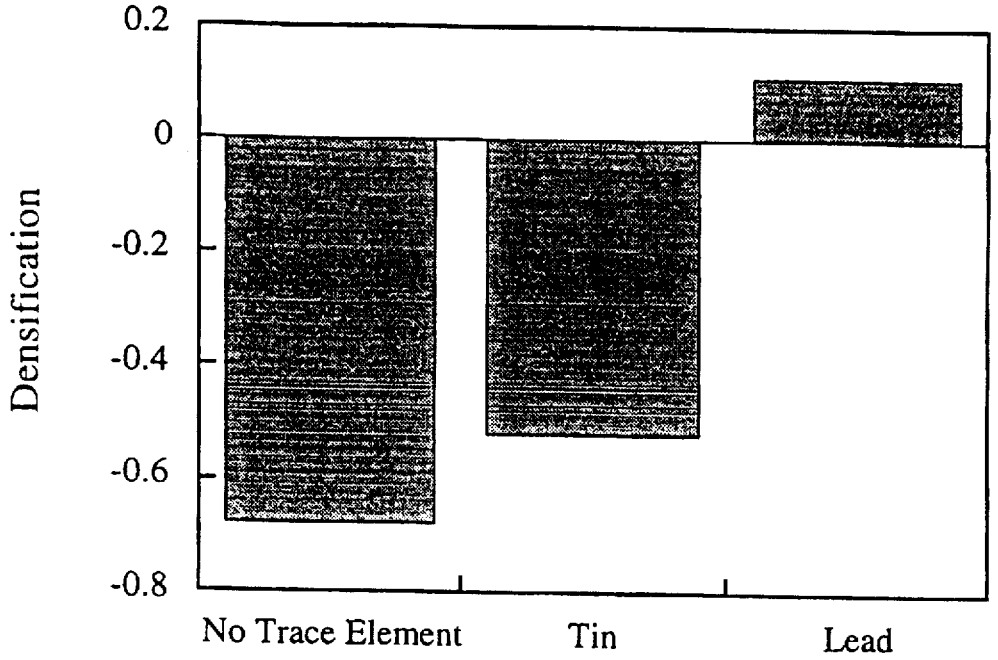
FIG. 1 is a graph depicting the effect of trace additions of lead and tin on the densification of an Al-8Zn-2.5Mg-1Cu-0.07X alloy where X is the lead or tin. Negative numbers indicate expansion; positive numbers indicate shrinkage.
Figure 2:
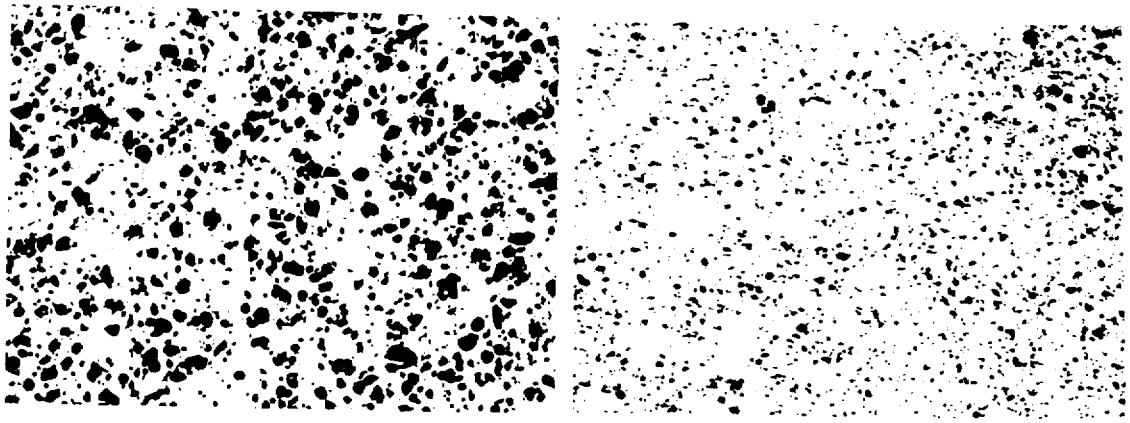
FIG. 2 presents reflected light micrographs of polished sections of sintered material showing the effect of trace additions of lead on the porosity of an Al-8Zn-2.5Mg-1Cu alloy. The material the subject of panel (a) had no trace addition while the material the subject of panel (b) contained 0.07 wt % lead. Magnification: 46X.
Figure 3:
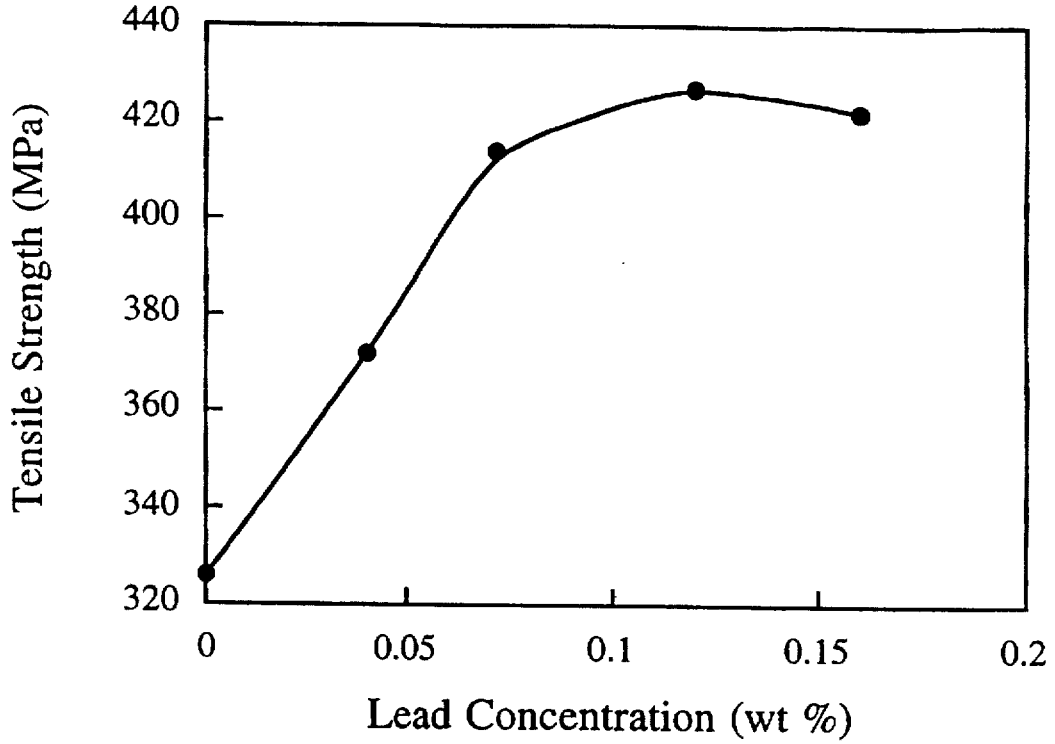
FIG. 3 is a graph showing the effect of trace lead addition on the tensile strength of an Al-8Zn-2.5Mg-1Cu alloy (T6 condition).

The material is based on the precipitation hardenable 7000 series Al-Zn-Mg-Cu alloys with trace additions of lead or tin. Lead is preferred for the attainment of high sintered densities and hence improved mechanical properties. Tin shows a similar but reduced effect. The addition of 100 ppm lead to an Al-8Zn-2.5Mg-1Cu alloy increases the sintered density so that the compact shrinks rather than expands during sintering. This is illustrated in FIG. 1, while the effect on the microstructure is shown in FIG. 2. The influence of lead on the tensile strength is apparent from the data of FIG. 3; here the addition of 0.12 wt % Pb increases the tensile strength of the Al-8Zn-2.5Mg-1Cu alloy by more than 30%. The lead may be added as an elemental addition or it may be pre-alloyed with the zinc.

Figure 4:
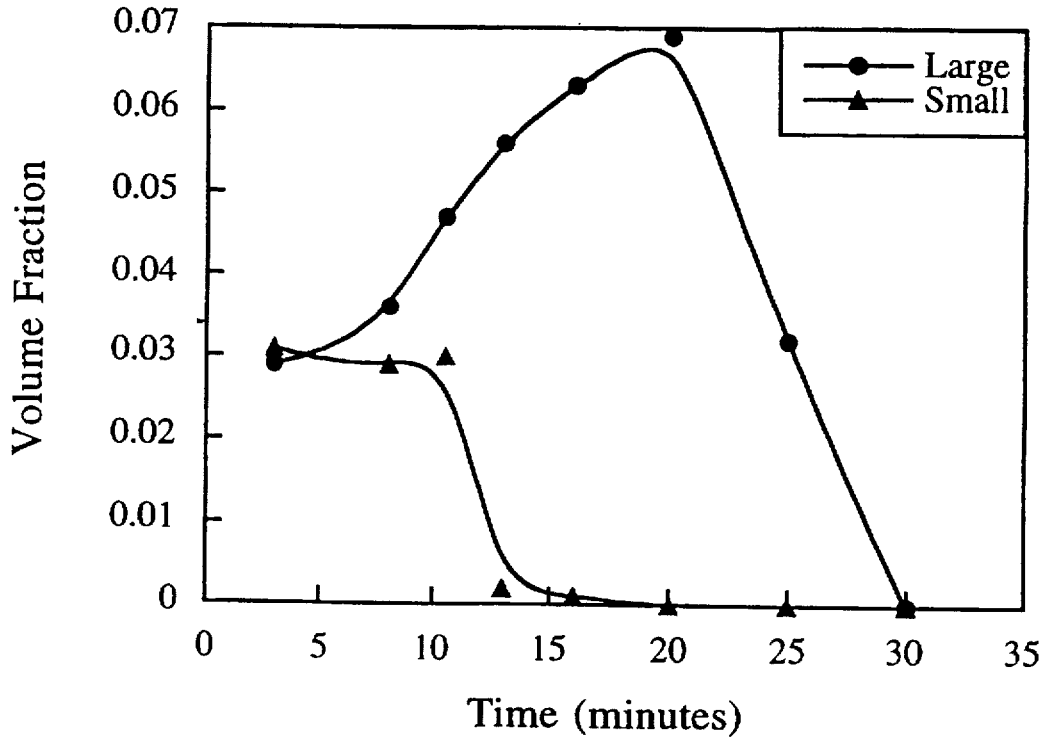
FIG. 4 is a graph of the effect of zinc particle size on the quantity of liquid phase formed during sintering of a binary Al-10Zn alloy. Small particles were −325 mesh; large particles were −100 +120 mesh. Sintering was at 620° C. for 10 minutes. The heating rate was 10° C./min. The time is that for which the sample was above the melting point of zinc.

Zinc is the principle alloying addition. Its melting point is below the sintering temperature and it forms a number of binary and ternary eutectic phases. This should enhance sintering. However, zinc is highly soluble in aluminium and this is an impediment to its use as a sintering agent. When small zinc particles are used, the entire zinc addition is quickly absorbed by the aluminium and little or no liquid phases form, which hinders sintering. This has limited its previous application. In contrast, when large zinc particles are used, the aluminium adjacent to a zinc particle becomes locally saturated and elemental zinc persists long enough for enhanced liquid phase sintering to occur. The amount of liquid phase formed is therefore a function of the zinc particle size. This is illustrated in FIG. 4. Because the thermodynamic driving force is inversely proportional to the particle size and because the smaller particle sizes aid particle packing, the zinc size needs to be optimised. The zinc size effect is also dependent on other process variables such as heating rate and compaction pressure. These also need to be optimised. A similar particle size effect occurs in other systems where there is some solid solubility of the additive in the base element and where there is a diffusive flow from the additive to the base. Examples include copper in aluminium and copper in iron.

Magnesium is thought to disrupt the oxide film and also contributes to precipitation hardening. Copper improves the wetting of the aluminium by the sintering liquid, aids hardening and also improves the corrosion properties. Both are added as pure elements. A solid lubricant, such a stearic acid or waxes based on stearic acid, can be added to the powder blend to assist the compaction process. This can be removed prior to sintering by some thermal treatment or it can be removed during heating to the sintering temperature. The alloy is sintered in a high purity nitrogen atmosphere. It can then be heat treated in the conventional manner for aluminium alloys.

The following table, Table I, lists typical and preferred values for the aluminium alloy powder components and values for process steps in producing sintered alloy according to the invention. All compositions are in weight precent and particle sizes by screening (ASTM E-11 mesh numbers).

TABLE I

| PARAMETER | TYPICAL VALUE | PREFERRED VALUE |
|---|---|---|
| Zinc concentration | 2–12% | 4–8% |
| Magnesium concentration | 1–5% | 1.5–3.5% |
| Copper concentration | 0.1–5.6% | 1–4% |
| Lead or tin concentration | 0.01–0.3% | 0.03–0.15% |
| Aluminium powder size | −50 mesh | −100 mesh + 325 mesh |
| Zinc powder size | −60 mesh | −100 mesh |
| Magnesium powder size | −100 mesh | −200 mesh |
| Copper powder size | −60 mesh | −100 mesh |
| Compaction pressure | 50 MPa to 600 MPa | 200 MPa and 500 MPa |
| Heating rate | >5° C./min | 10° C./min to 40° C./min |
| Sintering temperature | 550° C. to 640° C. | 600° C. to 630° C. |
| Sintering time | <2 hours | 10 min to 30 min |

The invention is further described in and illustrated by the following examples. These examples should not be construed as limiting the invention is any way.

EXAMPLE 1

An alloy of 10Zn-2.5Mg-1Cu-0.09Pb-balance Al (wt %) was made by blending elemental powders with 1 wt % stearic acid as a solid lubricant in a tumbler mixer for 30 minutes. The aluminium powder was air atomised and passed through a 60 mesh screen. A rectangular bar was made by pressing this powder in a metal die at a pressure of 210 MPa. The zinc passed through a 100 mesh screen. The magnesium and the copper powder were both −325 mesh. The zinc was pre-alloyed with 0.9 wt % Pb. The green compact was then sintered under a nitrogen atmosphere at a temperature of 600° C. for 30 minutes. It was heated to the sintering temperature at a rate of 20° C. per minute. The sample was air cooled and subsequently solution treated in air at 490° C. for 1 hour. A tensile specimen was machined from the bar. It had a tensile strength (T4 condition) of 332 MPa and an elongation to failure of 1%.

EXAMPLE 2

An alloy was made as per Example 1 but with a composition of 6Zn-2.5Mg-3Cu-0.05Pb-balance Al (wt %) and was sintered at 610° C. It had a tensile strength in the T4 condition of 312 MPa and an elongation to failure of 1.17%.

EXAMPLE 3

An alloy was made as per Example 1 but with a composition of 8Zn-2.5Mg-1Cu-0.07Pb-balance Al (wt %) and a zinc particle size of −200 mesh. It was heated to the sintering temperature at a rate of 5° C. per minute and sintered for 2 hours. The tensile strength in the T4 condition was 328 MPa with an elongation to failure of 5.13%.

EXAMPLE 4

An alloy was made as per Example 3 but was artificially aged at 130° C. for 15 hours after solution treatment (T6 condition). The tensile strength was 444 MPa and the elongation to failure was 1.1%.

EXAMPLE 5

An alloy was made as per Example 1 but with a composition of 8Zn-2.5Mg-1Cu-0.12Pb-balance Al (wt %). Pure, un-alloyed zinc of particle size −325 mesh was used. Pure elemental lead (particle size −325 mesh) was added separately to the zinc. The sample was pressed at 410 MPa, heated at 10° C. per minute to the sintering temperature and sintered at 600° C. for 2 hours. It was tested in the T6 condition. The tensile strength was 424 MPa and the elongation to failure was 0.65%.

EXAMPLE 6

An alloy was made as per Example 5 but with 0.09 wt % tin replacing the 0.12 wt % lead addition. The tensile strength in the T6 condition was 365 MPa.

EXAMPLE 7

An alloy was made as per Example 1 but with a composition of 6Zn-2.5Mg-1Cu-0.05Pb-balance Al (wt %). The aluminium had the −325 mesh powder size removed. Zinc of particle size −100 mesh and copper of particle size 200 mesh was used. The alloy was heated at 40° C. per minute to the sintering temperature and sintered at 620° C. for 20 minutes. It had a tensile strength in the T4 condition of 304 MPa and an elongation to failure of 5.57%.

INDUSTRIAL APPLICABILITY

Alloy produced from starting powder or composite according to the invention is suitable for manufacturing articles for use in the technology fields listed hereafter. The list should in no way be considered exhaustive and is merely provided for further exemplification.

1. Sintered and heat treated automotive components such as cam shaft pulleys, cam shaft and crank shaft gears, cam shaft lobes, oil pump gears, transmission components including synchronising rings, water pump impellers, bearing caps and battery terminal clamps.
2. Sintered and heat treatment components for business machines and computer equipment such as pulleys and gears.
3. Powder forged components for high cyclic stress environments such as connecting rods in internal combustion engines, automotive suspension and brake components, recording heads in video and audio tape recorders and disk drive components in computers and related equipment.

It will be appreciated that many changes can be made to the alloys as exemplified above without departing from the broad ambit of the invention, which ambit is to be limited only by the appended claims.

We claim:

1. A starting powder blend for producing a sintered aluminum alloy, said starting powder blend consisting essentially of 2–12 wt % zinc, 1–5 wt % magnesium, 0.1–5.6% copper, 0.01–0.3 wt % lead or tin, and the balance aluminium.

2. The starting powder according to claim 1, wherein the concentrations of said components are: zinc, 4–8 wt %; magnesium, 1.5–3.5 wt %; copper 1–4 wt %; and lead, 0.03–0.15 wt %.

3. The starting powder according to claim 1, wherein the concentrations of said components are: zinc, 4–8 wt %; magnesium, 1.5–3.5 wt %; copper 1–4 wt %; and tin, 0.03–0.15 wt %.

4. The starting powder according to claim 1, which further includes a solid lubricant.

5. The starting powder according to claim 4, wherein said solid lubricant is stearic acid or waxes based on stearic acid, or other organic lubricant.

6. The starting powder according to claim 5, wherein said solid lubricant is stearic acid at a concentration of 0.1–2 wt %.

7. The starting powder according to claim 6, wherein said stearic acid concentration is 0.5–1 wt %.

8. The starting powder according to claim 1, wherein said zinc has a particle size of 60 mesh to dust and said aluminium has a particle size of 50 mesh to dust.

9. A composite starting powder for a sintered aluminium alloy, said powder consisting essentially of a starting powder according to claim 1 together with at least one reinforcing element or compound.

10. The composite powder according to claim 9, wherein said reinforcing element or compound is selected from carbon, carborundum, corundum, titanium diboride, fly ash, cermets, silicon carbide or other oxides, carbides, nitrides and borides effective to provide reinforcement.

11. The composite powder according to claim 9, wherein said reinforcing element or compound comprises 2 vol % to 50 vol % of the composite with the balance said starting powder.

12. The composite powder according to claim 11, wherein said reinforcing element or compound comprises 5 vol % to 30 vol % of the composite.

13. A sintered aluminium alloy, which alloy is produced by the steps of:

(i) compacting a powder according to claim 1 or a composite according to claim 9 at a pressure of up to 600 MPa; and (ii) sintering said compacted material from step (i) at a temperature of 550° C. to 640° C.

14. The aluminium alloy according to claim 13, wherein said compaction pressure is greater than 50 MPa.

15. The aluminium alloy according to claim 13, wherein said compaction pressure is 200 MPa to 500 MPa.

16. The aluminium alloy according to claim 13, wherein said compacted material is heated to the sintering temperature at a rate greater than 5° C./min.

17. The aluminium alloy according to claim 16, wherein said rate is between 10° C./min and 40° C./min.

18. The aluminium alloy according to claim 13, wherein said compacted material is held at the sintering temperature for not more than 2 hours.

19. The aluminium alloy according to claim 13, wherein said compacted material is held at the sintering temperature for 10–30 minutes.

20. The aluminium alloy according to claim 13, wherein the sintering temperature is 600–630° C.

21. An article manufactured from the sintered aluminium alloy of claim 13.

* * * * *

UNITED STATES PATENT AND TRADEMARK OFFICE

CERTIFICATE OF CORRECTION

PATENT NO. : 5,902,943

DATED : May 11, 1999

INVENTOR(S) : Graham Barry Schaffer et al.

It is certified that error appears in the above-identified patent and that said Letters Patent is hereby corrected as shown below:

In Column 4, line 21, delete "precent" and insert therefor -- percent--
In Column 4, lines 35, and 36 delete in column labled "PREFERRED VALUE" in Table I "and" and insert therefor -- to--
In Column 5, line 66, delete "blend" and insert therefor --blended--
In Column 6, line 32, delete "other" between "or" and "oxides"

Signed and Sealed this

Twentieth Day of February, 2001

*Attest:*

Nicholas P. Godici

NICHOLAS P. GODICI

*Attesting Officer*

*Acting Director of the United States Patent and Trademark Office*